United States Patent [19]

Cook

[11] Patent Number: 4,482,330

[45] Date of Patent: Nov. 13, 1984

[54] OUTBOARD MOTOR MOUNTING APPARATUS

[75] Inventor: Greg Cook, Duncan, Okla.

[73] Assignee: Cook Machine Company, Duncan, Okla.

[21] Appl. No.: 465,807

[22] Filed: Feb. 11, 1983

[51] Int. Cl.[3] ..... B63H 21/26

[52] U.S. Cl. ..... 440/2; 248/640; 440/61

[58] Field of Search ..... 440/2, 61, 53, 58–63; 248/640, 641

[56] References Cited

U.S. PATENT DOCUMENTS 2,908,242 10/1959 Forbes et al. ..... 440/61

3,931,784 1/1976 Collis et al. ..... 440/2

4,232,627 11/1980 Glenn et al. ..... 440/61

*Primary Examiner*—Sherman D. Basinger

*Attorney, Agent, or Firm*—Dunlap & Codding

[57] ABSTRACT

An apparatus for mounting an outboard motor on the transom of a boat so that the motor can be raised and lowered on the transom. The apparatus comprises two slidably connected brackets, one for securing to the transom of the boat and one for carrying the outboard motor, and a hydraulic actuating cylinder connected between the two brackets for moving the motor mounting bracket along a vertical line relative to the bracket secured to the transom. A reversible hydraulic pump is provided for operating the hydraulic actuating cylinder.

10 Claims, 7 Drawing Figures

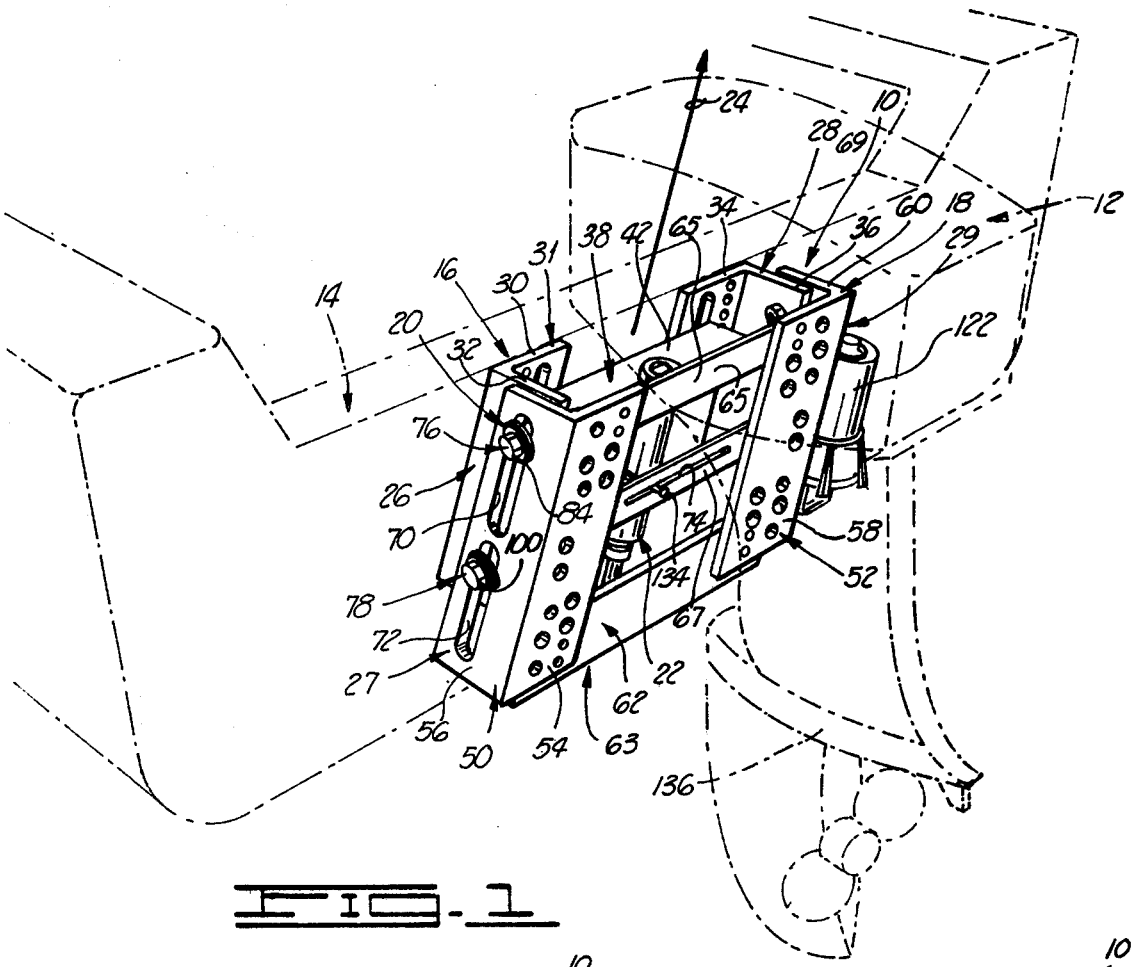
FIG. 1
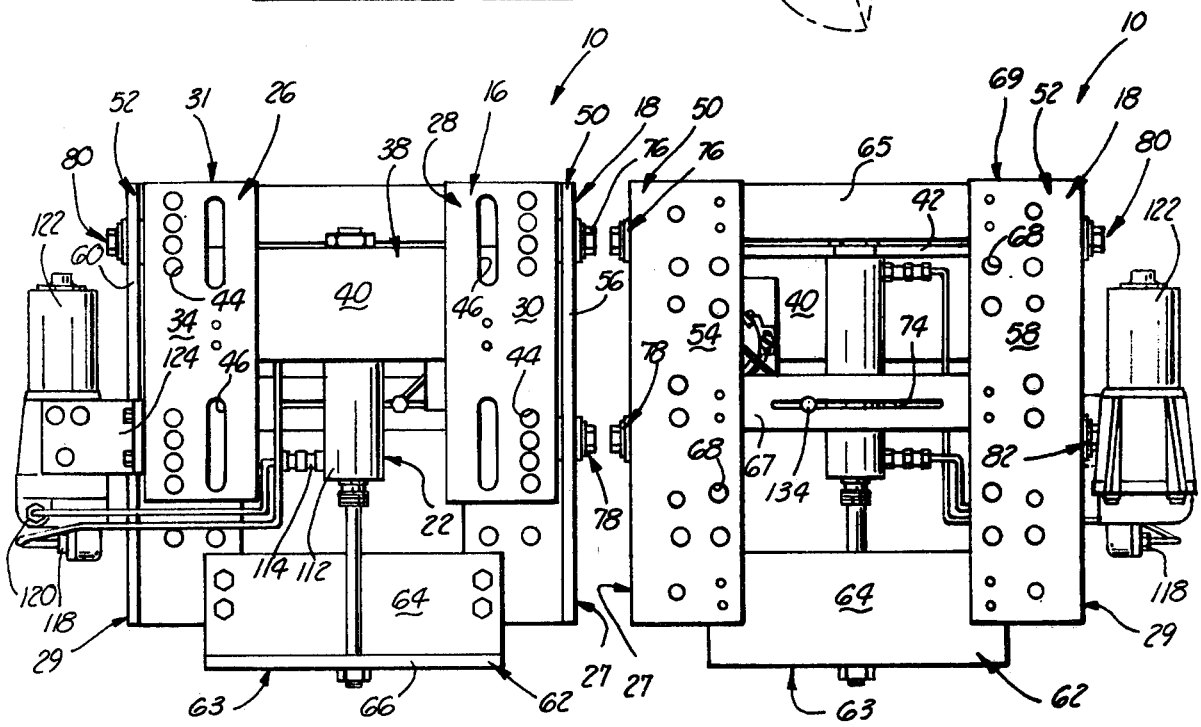
FIG. 2
FIG. 3

OUTBOARD MOTOR MOUNTING APPARATUS

BACKGROUND OF THE INVENTION

The present invention relates generally to improvements in the art of marine propulsion and, more particularly, to apparatus for vertically positioning outboard motors on the transoms of boats.

For maximum efficiency of operation, an outboard motor should be mounted on the transom of a boat such that the cavitation plate of the motor runs across the surface of the water while the boat is being operated. At such a height, the cavitation plate will be appropriately positioned to carry out its function of preventing air from reaching the propeller area, thereby preventing cavitation or slippage of the propeller in the water that can reduce the efficiency of operation of the motor, while, at the same time, the water will produce only a minimal drag on the motor to be overcome by the motor during the operation of the boat.

While this criterion for motor positioning has long been known, practical problems have in many cases prevented the criterion from being met, especially where a boat may be used for a variety of purposes. For example, an appropriate height setting for the motor where a boat is to be used as a work boat, operating at relatively low speed but requiring maximum thrust, is generally such that the cavitation plate will be positioned one to three inches higher than the bottom of the boat. This same setting, however, would not be appropriate where the boat should, at some other time, be used for racing purposes. At the higher speeds involved in racing, the stern of the boat is lower in the water requiring a setting of the cavitation plate generally of the order of three to five inches above the bottom of the boat to prevent excessive drag and to permit maximum speed to be obtained with propellers designed especially for racing purposes.

While the motor can be secured to the transom at different heights at different times to adjust for different uses to which a boat may be put, a practice that has occurred in the past, such solution to the problem is not only inconvenient and time consuming but introduces further problems. For example, where a boat is to be used for racing, mounting the motor at a height appropriate for conditions existing during the race results in a very low starting thrust for the motor so that the price paid for maximizing efficiency at high operating speeds is excessive time required to reach such speeds.

SUMMARY OF THE INVENTION

The present invention solves these and other problems by providing a motor mounting apparatus that can be permanently affixed to the transom of a boat, to support the motor, and is adjustable to permit the motor to be rapidly and easily positioned vertically on the transom of the boat. In particular, the apparatus of the present invention comprises a transom bracket which is fixed to the transom of a boat and a motor bracket to which the motor can be secured. The motor bracket is slideably mounted on the transom bracket for movement thereon along a line of movement extending vertically along the transom and a hydraulic actuating cylinder and reversible hydraulic pump are provided to move the motor bracket vertically relative to the transom bracket. The movement of the motor bracket via the hydraulic actuating cylinder and reversible pump can conveniently be controlled from the boat cockpit by a conventional switching circuit that provides electrical power, of one or an opposite electrical polarity, to the pump from a conventional automotive type battery so that the adjustment of the motor height can be carried out while the boat is in operation. Since the height of the motor on the transom can be varied during operation, the motor can always be operated at maximum efficiency.

An object of the present invention is to maximize the operating efficiency of outboard motor powered boats.

Another object of the invention is to facilitate the use of outboard motor powered boats for a variety of purposes without forfeiting operating characteristics and efficiency desired in one application of the boat to meet characteristics and efficiency considerations desired when the boat is to be put to some other use.

A further object of the invention is to enable adjustment of the operating characteristics of an outboard motor powered boat while the boat is in operation to match the operation of the boat and motor to instantaneously occurring conditions existing during the operation of the boat.

Other objects, advantages and features of the present invention will become clear from the following detailed description of the preferred embodiment of the invention when read in conjunction with the drawings and appended claims.

BRIEF DESCRIPTION OF THE DRAWINGS

FIG. 1 is a perspective view of the motor mounting apparatus of the present invention showing the relative positions of the apparatus, the transom of a boat upon which the apparatus is mounted, and a motor that is mounted on the apparatus.

FIG. 2 is a front elevational view of the apparatus shown in FIG. 1.

FIG. 3 is a rear elevational view of the motor mounting apparatus.

DESCRIPTION OF THE PREFERRED EMBODIMENT

Figure 4:
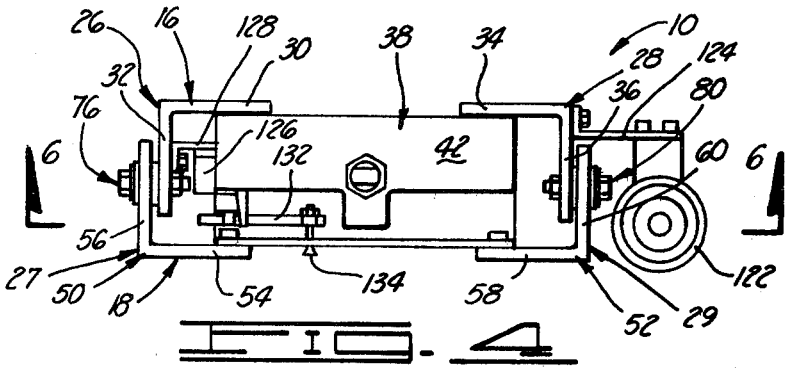
FIG. 4 is a plan view of the motor mounting apparatus.

Referring now to the drawings in general and to FIG. 1 in particular, shown therein and designated by the general reference numeral 10 is an apparatus constructed in accordance with the present invention for mounting an outboard motor on the transom of a boat. The motor and portions of the boat have been indicated in dot-dash line in FIG. 1 and designated by the numbers 12 and 14, respectively, therein to indicate the positioning of the apparatus 10 on the boat 14, the positioning of the motor 12 on the apparatus 10, and the relative movement of portions of the apparatus 10 to be discussed below. As shown in FIG. 1, the apparatus 10 generally comprises: (1) a transom bracket 16 that is secured to the transom of the boat 14, for example by bolting the transom bracket 16 to the transom; (2) a motor bracket 18, upon which the motor 14 can be mounted by bolting the integral mounting system (not shown) of the motor to the motor bracket 18; (3) a bearing assembly 20 slideably connecting the motor bracket 18 to the transom bracket 16; and (4) a motor bracket positioning assembly 22 for sliding the motor bracket 18 on the transom bracket 16 along a selected line of movement 24. As can be seen in FIG. 1, the transom bracket 16 is mounted on the transom of the boat 14 such that the selected line of movement 24 is oriented relative to the boat 14 for vertical movement of the motor 12 thereon.

Figure 6:
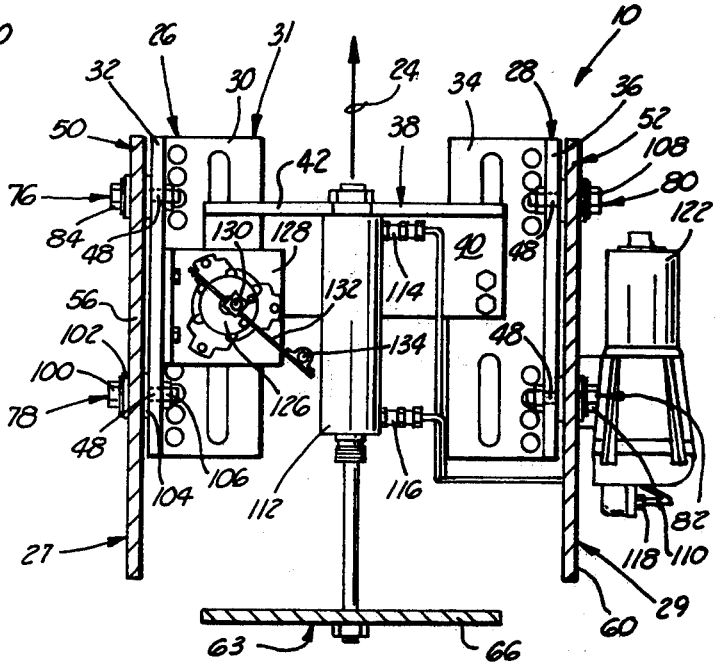
FIG. 6 is an elevational cross section of the motor mounting apparatus taken along line 6—6 of FIG. 4.

The construction of the transom bracket 16 has been particularly illustrated in FIGS. 2, 4 and 6 as well as in FIG. 1. As shown in these drawings, the transom bracket 16 comprises first and second angle members, 26 and 28 respectively, disposed generally at first and second sides, 27 and 29 respectively, of the apparatus 10. As is indicated in FIG. 4, the webs of the angle members 26 and 28 are positioned to provide the transom bracket 16 with a generally U-shaped configuration about the line of movement 24 of the motor bracket 18 on the transom bracket 16. In particular, one web of the first angle member 26 of the transom bracket 16 forms a transom bracket first base plate 30 that is secured to the transom of the boat to extend therealong generally parallel to the line of movement 24. The other web of the first angle member 26 extends generally perpendicular to the transom of the boat and generally parallel to the line of movement 24 to form a first side plate 32 (FIGS. 1, 4 and 6) of the transom bracket 16 disposed generally along the first side 27 of the apparatus 10. The second angle member 28 similarly comprises a transom bracket second base plate 34 secured to and extending along the boat transom and a transom bracket second side plate 36 extending generally perpendicularly from the second base plate 34 and generally parallel to the transom bracket first side plate 32 along the second side 29 of the apparatus 10. Additionally, the transom bracket 16 comprises a transom bracket cross angle member 38 having a first web 40, bolted to the transom bracket base plates 30, 34 and extending therebetween, and a second web 42 extending perpendicularly to the webs 30–38 of the transom bracket angle members 26, 28 and generally perpendicularly to the line of movement 24 of the motor bracket 18 on the transom bracket 16. For a purpose to be discussed below, the transom bracket cross angle member is conveniently disposed near the end 31 of the transom bracket 16 that will be disposed uppermost when the apparatus 10 is mounted on the transom of the boat 14.

For mounting the apparatus 10 on the boat 14, the base plates 30, 34 of the transom bracket 16 are provided with a plurality of holes 44 and slots 46 by means of which the transom bracket 16 can be bolted to the transom of a boat, such as the boat 14. The holes 44 and slots 46 are positioned in accordance with the locations of bolting members by means of which various motors would be mounted on various boats in the absence of the use of the apparatus 10 to facilitate the mounting of the apparatus 10 on the transom of the boat 14. In addition, threaded holes, indicated by dotted lines in FIG. 6 and designated by the numeral 48 therein, are formed through the transom bracket side plates 32, 36 for a purpose to be discussed below.

Figure 5:
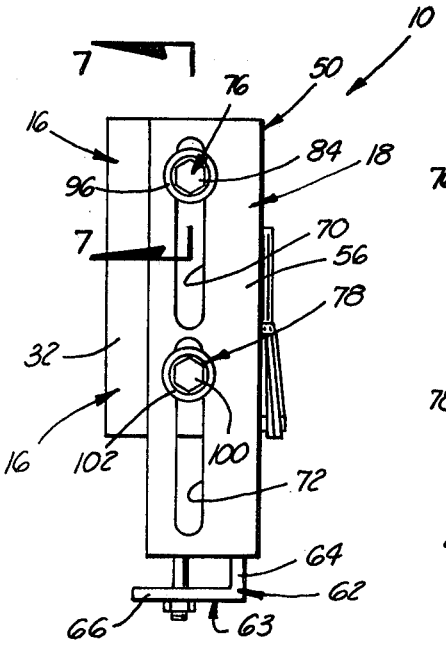
FIG. 5 is a side elevational view of the motor mounting apparatus.

The motor bracket 18, particularly shown in FIGS. 3, 4 and 5 as well as in FIG. 1, similarly comprises two spaced angle members, a motor bracket first angle member 50 disposed generally along the first side 27 of the apparatus 10 and a motor bracket second angle member 52 disposed generally along the second side 29 of the apparatus 10. As in the case of the webs of the angle members of the transom bracket 16, the webs of the angle members 50, 52 of the motor bracket are disposed to provide the motor bracket 18 with a generally U-shaped configuration extending about the line of movement 24 of the motor bracket 18 along the transom bracket 16. Thus, the motor bracket first angle member 50 comprises one web forming a motor bracket first base plate 54 disposed parallel to, and spaced a distance from, the first base plate 30 of the transom bracket 16 and a second web, forming a motor bracket first side plate 56, disposed along the first side 27 of the apparatus 10 to generally parallel the first side plate 32 of the transom bracket 16. Similarly, the motor bracket second angle member 52 has a web paralleling the second base plate 34 of the transom bracket 18 to form a second base plate 58 for the motor bracket 18 and a web paralleling the transom bracket second side plate 36 to form a second side plate 60 for the motor bracket 18 along the second side 29 of the apparatus 10. As is particularly shown in FIG. 1, the spacing of the side plates 56, 60 of the motor bracket 18 is slightly greater than the spacing of the side plates 32, 36 of the transom bracket 16 and the side plates of the motor bracket 16 are disposed about the outer sides of the side plates of the transom bracket 16 to facilitate the mounting of the motor bracket 18 on the transom bracket 16 in a manner to be discussed below. In addition, to the angle members 50 and 52, the motor bracket 18 comprises a cross angle member 62, disposed at the lowermost end 63 of the motor bracket 18 at such times that the apparatus 10 is mounted on the boat 14 and upper and medial braces, 65 and 67 respectively, disposed near the uppermost end 69 and midpoint, respectively, of the motor bracket 18 at such times that the apparatus 10 is mounted on the boat 14. The braces 65 and 67 are conveniently bolted to the motor bracket base plates 54 and 58 and extend therebetween to form the motor bracket 18 into a substantially rigid structure. As in the case of the cross angle member 38 of the transom bracket 16, the cross angle member 62 of the motor bracket 18 has a first web 64 bolted to the motor bracket base plates 54, 58, to extend therebetween, and a second web 66 extending from the first web 64 generally perpendicularly to the line of movement 24 of the motor bracket 18 on the transom bracket 16.

As can be particularly seen in FIGS. 1–3, the second web 42, 66 of each cross angle member 38, 62 is supported by the base plate of one of the brackets 16, 18 to extend generally toward the other of the brackets 16, 18. Thus, in conjunction with the disposition of the cross angle member 38 of the transom bracket 16 near the upper end 31 of the transom bracket 16 and the disposition of the cross angle member 62 of the motor bracket 18 at the lower end 63 of the motor bracket 18, the second webs 42, 66 of the two cross angle members will be disposed in a generally parallel, aligned relation in which the second webs 42, 66 are spaced along the line of movement 24 of the motor bracket 18 on the transom bracket 16.

In the same manner that the base plates 30, 34 of the transom bracket are provided with a plurality of holes and slots to facilitate mounting of the apparatus 10 on the transom of a boat, the base plates 54, 60 of the motor bracket 18 are provided with a plurality of holes 68 (FIG. 3) to facilitate mounting of an outboard motor on the motor bracket 18. As in the case of the holes and slots in the base plates of the transom bracket 16, the holes 68 are diversely positioned to permit a variety of commercially available outboard motors to be rapidly and easily mated to the motor bracket 18 via connecting means with which such motors are equipped.

In addition to the holes 68 in the motor bracket base plates 54, 58, the motor bracket 18 further has a pair of slots, such as the slots 70, 72 shown in FIGS. 1 and 5, formed through each of the side plates 56 and 60 thereof. (The slots 70, 72 in the motor bracket second side plate 60 have not been illustrated. Such slots are identical to the slots 70, 72 in the motor bracket first side plate 54 and placed identically to the placement of the slots 70, 72 in the motor bracket first side plate.) As shown in the drawings, the slots in the motor bracket side plates 54, 60 are disposed in a tandem arrangement and each slot in the side plates 56, 60 extends parallel to the line of movement 24 of the motor bracket 18 on the transom bracket 16 for mounting the bearing assembly 20 as will be discussed below. It will also be noticed, in FIGS. 1 and 3, that the medial brace 67 extending between the motor bracket base plates 54, 58 is provided with a slot 74 extending transversely to the direction of movement 24 of the motor bracket 18 on the transom bracket 16. The purpose of the slot 74 will be discussed below.

Coming now to the bearing assembly 20, such assembly is comprised of four identical subassemblies, two subassemblies being disposed at the first side 27 of the apparatus 10 and referred to herein as first side bearing subassemblies, 76 and 78, and two subassemblies being disposed at the second side 29 of the apparatus 10 and referred to herein as second side bearing subassemblies, 80 and 82 (see FIG. 3). The bearing subassemblies 76–82 are identical in structure and are identically mounted between the transom bracket 16 and motor bracket 18 so that it will not be necessary for purposes of the present disclosure to describe each of the bearing subassemblies individually. Rather, it will suffice to describe the first side bearing subassembly 76 in detail and FIG. 7 has been provided for this purpose.

Figure 7:
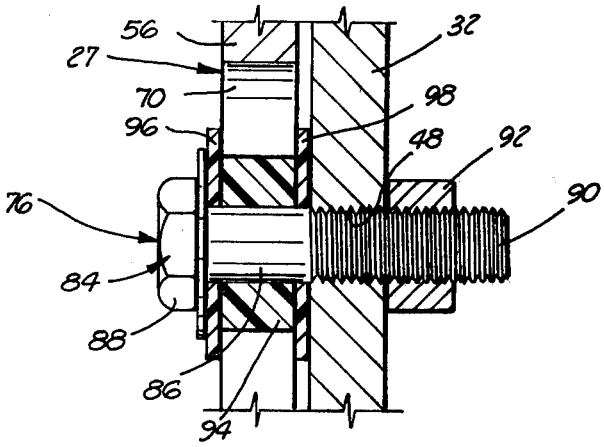
FIG. 7 is an elevational cross section of a portion of the bearing assembly of the motor mounting apparatus taken along line 7—7 of FIG. 5.

Referring now to FIG. 7, the first side bearing subassembly 76 comprises a first side bolt 84 that enters the slot 70 from the first side 27 of the apparatus 10 to pass through the slot 70 and screw into the uppermost hole 48 formed through the transom bracket first side plate 32. The shank of the first side bolt 76 includes an unthreaded portion 86 adjacent the bolthead 88 and a threaded portion 90 extending axially from the unthreaded portion 86. The length of the unthreaded portion 86 of the shank of the first side bolt 84 is made slightly longer than the width of the first side plate 56 of the motor mount 18, as shown in FIG. 7, so that the outer peripheral surface of the unthreaded portion 86 of the shank of bolt 88 provides a smooth bearing surface disposed within the slot 70 through the first side plate 56 of the motor bracket 18. By means of the threaded portion 90 of the first side bolt 88, this bearing surface formed on the first side bolt 84 can be precisely positioned with respect to the first side plate 32 of the transom bracket 16 and, once such surface has been positioned, the first side bolt 84 can be locked in place relative to the first side plate 32 of the transom bracket 16 by means of a lock nut 92 screwed onto the threaded portion 90 of the shank of the first side bolt 88, the threaded portion 90 of the bolt 84 having a length to protrude through the transom bracket first side plate 32 for this purpose. This locking feature of the first side bearing subassembly 76, in conjunction with the construction of portions of the first side bearing subassembly 76 now to be discussed, permits the motor bracket 18 to be mounted on the transom bracket 16 for smooth sliding movement thereon along the line of movement 24 as will become clear below.

In addition to the first side bolt 84 and the lock nut 92, the first side bearing subassembly 76 further comprises a first side sleeve 94 which is constructed of a lubricant impregnated organic polymer and is dimensioned to fit on the unthreaded portion 86 of the shank of the bolt 84 and move within the slot 70 formed through the first side plate 56 of the motor bracket 18. In particular, the length of the sleeve 94 is substantially equal to the thickness of the first side plate 56; the outside diameter of the sleeve 94 is substantially equal to the width of the slot 70; and the inside diameter of the sleeve 94 is substantially equal to the diameter of the unthreaded portion 86 of the shank of the first side bolt 88. The sleeve 94 is maintained within the slot 70 by means of two first side washers 96 and 98, similarly constructed of a lubricant impregnated organic polymer, mounted on the shank of the first side bolt 84 and positioned to either side of the first side plate 56 of the motor bracket 18. (A suitable material for use in constructing the sleeve 94 and washers 96, 98 is molybdenum disulfide impregnated nylon.) As can be seen in FIG. 7, one of the first side washers; that is, the washer 98, will be disposed between the first side plate 32 of the transom bracket 16 and the first side plate 56 of the motor bracket 18. In the preferred practice of the present invention, the brackets 16 and 18 are constructed such that the side plates 56, 60 of the motor bracket 18 are spaced sufficiently to extend about the side plates 32, 36 of the transom bracket 16 and further sufficient to leave a spacing between the side plates of the two brackets at each side of the apparatus 10 as has been shown in FIG. 4. The spacing between the side plates of the two brackets 16, 18 at each side of the apparatus, in conjunction with the above described construction of the bearing subassemblies 76–82, permits the bearing subassemblies 76–82 to be adjusted to permit a smooth sliding motion of the motor bracket 18 on the transom bracket 16 along the line of movement 24. In particular, the washers that are disposed between a side plate of the motor bracket 18 and a side plate of the transom bracket 16 are provided with a thickness substantially equal to the spacing between such side plates resulting from the greater spacing of the side plates of the motor bracket 18 than the spacing of the side plates of the transom bracket 18. Thus, by adjusting the position of the bolts of the bearing subassemblies 76–82 in the holes 48 of the side plates 32, 36 of the transom bracket 16, the frictional engagement between the sleeves and washers of the bearing subassemblies and the side plates of the two brackets can be adjusted to provide for smooth movement of the slots 70, 72 in the side plates of the motor bracket 18 over the sleeves 94 of the bearing subassemblies 76–82. Once the appropriate position of each of the bolts of the bearing subassemblies 76–82 has been located, the positions of these bolts can be fixed via the lock nuts 92 forming portions of the bearing subassemblies 76–82.

As can be seen in FIGS. 1 and 5, the first side bearing subassembly 78 is disposed with respect to the slot 72 in the first side plate 56 of the motor bracket 18 in a manner identical to the disposition of the first side bearing subassembly 76 with respect to the slot 70 through the first side plate 56. Thus, the first side bearing subassembly 78 comprises a first side bolt 100 that extends through the slot 72 to carry a first side sleeve (not shown) identical to the first side sleeve 94 shown in FIG. 7 within the slot 72, washers 102 and 104 (see FIG. 6) and a lock nut 106. Similarly, each of the bearing subassemblies 82 and 84 at the second side 29 of the apparatus 10 comprises a second side bolt (designated 108 and 110 in FIG. 6) which extends through a slot (not shown) formed through the second side plate 60 of the motor bracket 18 to screw into holes 48 in the second side plate 36 of the transom bracket 16. The bolts 108, 110 carry second side sleeves (not shown) identical to the sleeve 94 shown in FIG. 7 and disposed within the slots formed through the second side plate 60 in the same manner that the sleeve 94 shown in FIG. 7 is disposed within the slot 70 shown therein. Second side washers (not numerically designated in the drawings) are disposed on the second side bolts 108, 110 in the manner shown for the washers 96, 98 in FIG. 7 and lock nuts (not numerically designated in the drawings) are mounted on the bolts 108, 110 in the same manner that the lock nut 92 is mounted on the bolt 84 as shown in FIG. 7. Thus, each of the bearing subassemblies 76–82 can be individually adjusted, as described above, to provide for smooth sliding movement of the motor bracket 18 along the line of movement 24 on the transom bracket 16.

The motor bracket positioning assembly 22 has been particularly illustrated in FIGS. 2 and 6 to which attention is now invited. In particular, the motor bracket positioning assembly comprises a conventional hydraulic actuating cylinder 112 having fluid ports 114 and 116 that are connected by suitable hydraulic tubing (not numerically designated in the drawings) to fluid ports 118, 120 of a conventional, electrically powered, reversible hydraulic pump 122. As is particularly shown in FIG. 6, the hydraulic actuating cylinder 112 is disposed along the line of movement 24 of the motor bracket 18 on the transom bracket 16, the cylinder portion thereof is bolted to the second web 42 of the transom bracket transverse angle member 38, a hole (not shown) through the web 42 being provided for this purpose, and the piston rod portion of the actuating cylinder 112 is similarly connected to the second web 66 of the transverse angle member 62 of the motor bracket 18. Thus, by operating the reversible hydraulic pump 122 to introduce hydraulic fluid into the port 116 of the hydraulic actuating cylinder 112, the hydraulic actuating cylinder 112 can be caused to draw the second web 66 of the transverse angle member 62 of the motor bracket 16 toward the second web 42 of the transverse angle member 38 of the transom bracket 16 to draw the motor bracket 18 upwardly on the transom bracket 16 along the line of movement 24. Conversely, by operating the reversible hydraulic pump 122 to introduce hydraulic fluid into the port 114 of the hydraulic actuating cylinder 112, the second web 66 of the transverse angle member 62 of the motor bracket 18 is forced away from the second web 42 of the transverse angle member 38 of the transom bracket 16 to force the motor bracket 16 downwardly along the line of movement 24 on the transom bracket 16. The reversible hydraulic pump is selected to be operable from a 12 volt source so that a standard automotive battery (not shown) connected to the pump 122 through a conventional reversing switch (not shown) can be used to operate the hydraulic pump 122 to move the motor bracket 18 on the transom bracket 16 in either direction along the line of movement 24. As is shown in FIG. 4, the hydraulic pump 122 can be conveniently mounted on remaining portions of the apparatus 10 by bolting the pump 122 to a mounting bracket 124 that is, in turn, bolted to the second side plate 36 of the transom bracket 16. A suitable pump for use in the apparatus 10 is the model HYB 5001 pump manufactured by Prestolite Corporation of Toledo, Ohio and a suitable hydraulic actuating cylinder is the Type A cylinder manufactured by Allenair Corporation of Mineola, N.Y.

It is contemplated that many of the users of the apparatus 10 will be persons who will wish to use the boat upon which the apparatus 10 is mounted for a variety of purposes and, to facilitate positioning of the motor when the boat is switched from one use to another use, the apparatus 10 further comprises a motor bracket position indicator particularly illustrated in FIG. 6. In particular, the position indicator comprises a rheostat 126 that is supported on the first side plate 32 of the transom bracket 16 between the first base plate 30 of the transom bracket 16 and the first base plate 54 of the motor bracket 18 by means of a mounting bracket 128 that is bolted to the side plate 32. The rheostat 126 is of the conventional type having an input shaft 130 which can be rotated to change the resistance between electrical connections (not shown) to the rheostat 126. Such electrical connections can be connected to a conventional meter and battery system (not shown) so that meter readings provide an indication of the angular orientation of the input shaft 130 within the housing of the rheostat 126. In order to use the rheostat 126 to indicate the position of the motor bracket 18 on the transom bracket 16, a lever arm 132 is connected to the input shaft 130, the lever arm 132 carrying a pin 134 at the distal end thereof. As shown in FIGS. 3 and 4, the pin 134 extends through the slot 74 in the medial brace 67 connecting the base plates 54, 58 of the motor bracket 18. Thus, movement of the motor bracket 18 along the transom bracket 16 will pivot the lever arm 132 to change the resistance of the rheostat 126 and thereby provide an indication of the height of the motor bracket 18 on the transom bracket 16.

OPERATION OF THE PREFERRED EMBODIMENT

In use, the apparatus 10 will be mounted on the transom of a boat as has been shown in FIG. 1 and such mounting is preferably carried out via bolting the transom bracket 16 to the transom using the holes 44 and slots 46 through the base plates 30, 34 of the transom bracket 16 for this purpose. As noted above, the holes 44 and slots 46 are positioned to facilitate mating of the apparatus 10 to a variety of boats produced by diverse manufacturers. With the apparatus 10 mounted on the boat 14, the motor 12 can then be bolted to the base plates 54, 58 of the motor bracket substantially in the position such as that shown in FIG. 1. As in the case of the mounting of the transom bracket on the transom, the mounting of the motor can be effected by bolting the motor to the base plates 54, 58 of the motor bracket and a plurality of holes 68, diversely positioned, are formed through the base plates 54, 58 of the motor bracket 18 to facilitate mounting of motors provided by diverse manufacturers. With the transom bracket 16 so connected to the transom of the boat 14 and the motor 12 so mounted on the motor bracket 18, the reversible pump 122 can be connected to a suitable battery through a reversing switch which can be mounted in the cockpit of the boat so that the operator of the boat can raise and lower the motor bracket 18 on the transom bracket 16 and thereby raise and lower the motor 12 on the transom of the boat 14. Similarly, the rheostat 126 can be connected to a suitable meter located in the cockpit of the boat to guide the operator of the boat in the positioning of the motor 12 on the transom of the boat 14. With these connections made, the combined system of the boat 14, motor 12 and apparatus 10 will be ready for use.

In the use of the apparatus 10, the operator of the boat 14 will be able to derive maximum efficiency of operation, for any application of the boat 14, by positioning the cavitation plate, shown at 136 in FIG. 1, to just skim the surface of the water while the boat is in operation. In many circumstances, the boat will be used for a variety of purposes and the conditions under which the boat will be operated for each purpose will remain substantially fixed while the boat is being so operated. To meet these circumstances, the meter connected to the rheostat 126 can be calibrated to indicate the position of the cavitation plate 136 relative to the bottom of the boat 14 so that, each time the operator changes to a new application of the boat 14, the operator can quickly position the motor 12 for maximum efficiency of operation by observing the meter connected to the rheostat 126 while manually operating the switch connected to the reversible pump 122. However, in many circumstances, maximum efficiency of operation will change during a period of time in which the boat is being operated with an example being the application in which the boat 14 is being used for racing purposes. Under these circumsances, it is contemplated that the motor bracket 18 will initially be moved to a relatively low position on the transom bracket 16 in order to maximize the starting thrust of the motor 12 and, subsequently during operation of the boat 14, the operator of the boat will raise the motor bracket 18, and thereby the motor 12, as the boat begins to pick up speed. Thus, the apparatus 10 permits the motor 12 to be positioned relative to the boat 14 so that the boat will at all times be operated under optimum conditions.

In addition, the apparatus 10 can be operated in a manner to maximize the fuel efficiency of the motor 12. In particular, for any setting of the speed of the outboard motor 12, the operator of the boat 14 can adjust the position of the motor bracket 18 on the transom bracket 16, and thereby adjust the height of the motor 12 on the transom of the boat 14, to achieve maximum speed for the boat at the particular operating speed of the motor 12. By this means, the speed of the boat can be maximized, to minimize fuel consumption for any given distance of operation, at any desirable motor operating speed.

It is clear that the present invention is well adapted to carry out the objects and attain the ends and advantages mentioned as well as those inherent therein. While a presently preferred embodiment of the invention has been described for purposes of this disclosure, numerous changes may be made which will readily suggest themselves to those skilled in the art and which are encompassed within the spirit of the invention disclosed and as defined in the appended claims.

What is claimed is:

1. An apparatus for mounting an outboard motor on the transom of a boat, comprising:

a transom bracket mountable on the boat transom;

a motor bracket, slideably mounted on the transom bracket, for receiving the motor thereon, the transom bracket disposible on the transom for sliding movement of the motor bracket vertically on the transom; and means for sliding the motor bracket along the transom bracket whereby the motor can be raised and lowered on the transom via the motor mounting apparatus;

wherein the transom bracket comprises first and second side plates disposed parallel to the line of movement of the motor bracket on the transom bracket; wherein the motor bracket comprises:

a first side plate disposed parallel to and spaced from the first side plate of the transom bracket, the first side plate of the motor bracket having at least one slot formed therethrough parallel to the line of movement of the motor bracket on the transom bracket; and a second side plate disposed parallel to and spaced from the second side plate of the transom bracket, the second side plate of the motor bracket having at least one slot formed therethrough parallel to the line of movement of the motor bracket on the transom bracket;

wherein the side plates of the transom bracket are characterized as having threaded holes formed therethrough in alignment with the slots formed through the side plates of the motor bracket; and wherein the apparatus is further characterized as comprising a bearing assembly comprising:

a first side bolt screwed into a threaded hole in the first side plate of the transom bracket and extending through a slot in the first side plate of the motor bracket;

a first side sleeve constructed of a lubricant impregnated organic polymer, said sleeve mounted on portions of the first side bolt disposed within the slot formed through the first side plate of the motor bracket;

a pair of first side washers mounted on the first side bolt, one first side washer to either side of the first side plate of the motor bracket and both first side washers constructed of a lubricant impregnated organic polymer, whereby one first side washer is sandwiched between the first side plate of the transom bracket and the first side plate of the motor bracket, the sandwiched first side washer having a thickness substantially equal to the spacing between the first side plates of the transom and motor brackets;

a second side bolt screwed into a threaded hole in the second side plate of the transom bracket and extending through a slot in the second side plate of the motor bracket;

a second side sleeve constructed of a lubricant impregnated organic polymer, said sleeve mounted on portions of the second side bolt disposed within the slot formed through the second side plate of the motor bracket; and a pair of second side washers mounted on the second side bolt, one second side washer to either side of the second side plate of the motor bracket and both second side washers constructed of a lubricant impregnated organic polymer, whereby one second side washer is sandwiched between the second side plate of the transom bracket and the second side plate of the motor bracket, the sandwiched second side washer having a thickness substantially equal to the spacing between the second side plates of the motor and transom brackets.

2. The apparatus of claim 1 wherein the means for sliding the motor bracket along the transom bracket comprises:

a hydraulic actuating cylinder connected between the transom bracket and the motor bracket; and a reversible hydraulic pump fluidly connected to the ports of the hydraulic actuating cylinder.

3. The apparatus of claim 2 wherein the hydraulic pump is mounted on the transom bracket.

4. The apparatus of claim 1 wherein the side plates of the motor bracket are characterized as having two slots formed therethrough parallel to the direction of movement of the motor bracket on the transom bracket and wherein the bearing assembly comprises:

two first side bolts screwed into threaded holes in the first side plates of the transom bracket, one first side bolt extending through one slot in the first side plate of the motor bracket and the other first side bolt extending through the other slot in the first side plate of the motor bracket;

two first side sleeves constructed of a lubricant impregnated organic polymer, one first side sleeve mounted on portions of one of the first side bolts disposed within a slot formed through the first side plate of the motor bracket and the other first side sleeve mounted on portions of the other of the first side bolts disposed within the other slot formed through the first side plate of the motor bracket; and two pairs of first side washers, one pair of first side washers mounted on one of the first side bolts and the other pair of first side washers mounted on the other of the first side bolts, one first side washer of each pair to either side of the first side plate of the motor bracket and both first side washers of each pair constructed of a lubricant impregnated organic polymer, whereby one first side washer of each pair is sandwiched between the first side plate of the transom bracket and the first side plate of the motor bracket, the sandwiched first side washer of each pair of first side washers having a thickness substantially equal to the spacing between the first side plates of the motor bracket and the transom bracket;

two second side bolts screwed into threaded holes in the second side plate of the transom bracket, one second side bolt extending through one of the slots in the second side plate of the motor bracket and the other second side bolt extending through the other slot in the second side plate of the motor bracket;

two second side sleeves constructed of a lubricant impregnated organic polymer, one second side sleeve mounted on portions of one of the second side bolts disposed within a slot formed through the second side plate of the motor bracket and the other second side sleeve mounted on portions of the other second side bolt disposed within the other slot formed through the second side plate of the motor bracket; and two pairs of second side washers, one pair of second side washers mounted on one of the second side bolts and the other pair of second side washers mounted on the other of the second side bolts, one second side washer of each pair to either side of the second side plate of the motor bracket and both second side washers of each pair constructed of a lubricant impregnated organic polymer, whereby one second side washer of each pair is sandwiched between a second side plate of the transom bracket and the second side plate of the motor bracket, the sandwiched washer of each pair of second side washers having a thickness substantially equal to the spacing between the second side plates of the motor and transom brackets.

5. The apparatus of claim 1 further comprising means for providing an indication of the position of the motor bracket on the transom bracket.

6. An apparatus for mounting an outboard motor on the transom of a boat, comprising:

a transom bracket mountable on the boat transom;

a motor bracket, slideably mounted on the transom bracket, for receiving the motor thereon, the transom bracket disposible on the transom for sliding movement of the motor bracket vertically on the transom; and means for sliding the motor bracket along the transom bracket whereby the motor can be raised and lowered on the transom via the motor mounting apparatus;

wherein the transom bracket comprises:

a first angle member extending parallel to the line of movement of the motor bracket on the transom bracket;

a second angle member extending parallel to the line of movement of the motor bracket on the transom bracket, one web of each of the angle members of the transom bracket paralleling a web of the other angle member of the transom bracket, said parallel webs of the angle members forming first and second side plates of the transom bracket, and one web of each of the angle members of the transom bracket extending toward the other angle member of the transom bracket to form first and second base plates of the transom bracket, whereby the transom bracket has a generally U-shaped configuration; and wherein the motor bracket comprises:

a first angle member extending parallel to the line of movement of the motor bracket on the transom bracket;

a second angle member extending parallel to the line of movement of the motor bracket on the transom bracket, one web of each of the angle members of the motor bracket paralleling a web of the other angle member of the motor bracket, said parallel webs of the angle members of the motor bracket forming first and second side plates of the motor bracket, and one web of each of the angle members of the motor bracket extending toward the other angle member of the motor bracket to form first and second base plates of the motor bracket, whereby the motor bracket has a generally U-shaped configuration; and wherein the spacing between the side plates of the motor bracket is larger than the spacing between the side plates of the transom bracket and the motor bracket is mounted on the transom bracket with the side plates of the motor bracket disposed about the side plates of the transom bracket.

7. The apparatus of claim 6 wherein each of the side plates of the motor bracket are characterized as having at least one slot formed therethrough parallel to the line of movement of the motor bracket on the transom bracket; wherein the side plates of the transom bracket are characterized as having threaded holes formed therethrough in alignment with the slots formed through the side plates of the motor bracket; and wherein the apparatus is further characterized as comprising a bearing assembly comprising:

a first side bolt screwed into a threaded hole in the first side plate of the transom bracket and extending through a slot in the first side plate of the motor bracket;

a first side sleeve constructed of a lubricant impregnated organic polymer, said sleeve mounted on portions of the first side bolt disposed within the slot formed through the first side plate of the motor bracket; and a pair of first side washers mounted on the first side bolt, one first side washer to either side of the first side plate of the motor bracket and both first side washers constructed of a lubricant impregnated organic polymer, whereby one first side washer is sandwiched between the first side plate of the transom bracket and the first side plate of the motor bracket, the sandwiched first side washer having a thickness substantially equal to the spacing between the first side plates of the transom and motor brackets;

a second side bolt screwed into a threaded hole in a second side plate of the transom bracket and extending through a slot in the second side plate of the motor bracket;

a second side sleeve constructed of a lubricant impregnated organic polymer, said sleeve mounted on portions of the second side bolt disposed within the slot formed through the second side plate of the motor bracket; and a pair of second side washers mounted on the second side bolt, one second side washer to either side of the second side plate of the motor bracket and both second side washers constructed of a lubricant impregnated organic polymer, whereby one second side washer is sandwiched between the second side plate of the transom bracket and the second side plate of the motor bracket, the sandwiched second side washer having a thickness substantially equal to the spacing between the second side plates of the motor and transom brackets.

8. The apparatus of claim 6 wherein the transom bracket further comprises a transom bracket cross angle member having a first web secured to the base plates of the transom bracket and extending therebetween and having a second web disposed substantially normally to the line of movement of the motor bracket on the transom bracket; wherein the motor bracket further comprises a motor bracket cross angle member having a first web secured to the base plates of the motor bracket and extending therebetween and having a second web disposed substantially normally to the line of movement of the motor bracket on the transom bracket; and wherein the means for sliding the motor bracket along the transom bracket comprises:

a hydraulic actuating cylinder connected between the second web of the transom bracket cross angle member and the second web of the motor bracket cross angle member; and a reversible hydraulic pump fluidly connected to the ports of the hydraulic actuating cylinder.

9. An apparatus for mounting an outboard motor on the transom of a boat, comprising:

a transom bracket mountable on the boat transom;

a motor bracket, slideably mounted on the transom bracket, for receiving the motor thereon, the transom bracket disposible on the transom for sliding movement of the motor bracket vertically on the transom;

means for sliding the motor bracket along the transom bracket whereby the motor can be raised and lowered on the transom via the motor mounting apparatus; and means for providing an indication of the position of the motor bracket on the transom bracket, comprising;

a rheostat mounted on the transom bracket and having a resistance variable via positioning of an input shaft to the rheostat; and a lever arm connected between the rheostat input shaft and the motor bracket;

wherein the motor bracket is characterized as having a slotted brace member disposed transversely to the line of movement of the motor bracket on the transom bracket and wherein the lever arm is connected to the motor bracket via a pin disposed in the slot of said brace member.

10. The apparatus of claim 9 wherein the means for sliding the motor bracket along the transom bracket comprises:

a hydraulic actuating cylinder connected between the transom bracket and the motor bracket; and a reversible hydraulic pump fluidly connected to the ports of the hydraulic actuating cylinder.

* * * * *